United States Patent [19]

Bennett

[11] 3,953,980

[45] May 4, 1976

[54] DOCK STRUCTURE

[75] Inventor: Gerald B. Bennett, Clarkston, Mich.

[73] Assignee: Floyd William Bennett, Clarkston, Mich.

[22] Filed: Jan. 13, 1975

[21] Appl. No.: 540,725

[52] U.S. Cl. ..... 61/48; 14/18; 14/71 R; 104/89

[51] Int. Cl.[2] ..... E02B 3/20

[58] Field of Search ..... 61/48, 67; 14/18, 71 R; 104/89, 92; 238/11

[56] References Cited

UNITED STATES PATENTS

| | | | |
|---|---|---|---|
| 2,948,121 | 8/1960 | Karst | 61/48 |
| 3,046,748 | 7/1962 | Monroe | 61/48 |
| 3,074,239 | 1/1963 | Mustard | 61/48 |
| 3,287,919 | 11/1966 | Hahn | 61/48 |
| 3,421,327 | 1/1969 | Donaldson | 61/48 |
| 3,685,074 | 8/1972 | Marshall | 14/18 |
| 3,686,876 | 8/1972 | Muschell | 61/48 |
| 3,747,354 | 7/1973 | Macomber | 14/71 |
| 3,824,796 | 7/1974 | Nasby, Sr. | 61/48 |

*Primary Examiner*—Paul R. Gilliam
*Assistant Examiner*—David H. Corbin
*Attorney, Agent, or Firm*—Hauke, Patalidis & Dumont

[57] ABSTRACT

The dock includes a pair of substantially vertical support members having a vertically adjustable collar mounted on each. The deck portion of the dock has one end attached to the pair of adjustable collars and the other end supported through at least one pair of cables, each attached proximate the free end of the deck member and passing over a V-way at the top of the respective vertical support member with its other end finally anchored to the ground inland of the shoreline. The dock is thus vertically adjustable by means of the cables and collars to accommodate to the height of the changing levels of water. It is furthermore pivotable upwardly from the water surface to avoid damage such as might result in periods of high water or winter ice formation along the shoreline.

8 Claims, 11 Drawing Figures

DOCK STRUCTURE

BACKGROUND OF THE INVENTION

A wide variety of dock structures are known in the prior art, some of which are free-floating on the surface of the water to allow for different water levels. Most docks, however, include permanently situated posts driven into the ground beneath the surface of the water, with the deck structures and support members being rigidly attached and incapable of adjustment once they are set in place. All such docks require removal to prevent damage by ice accumulation. It is an important consideration that there is a slow but continuous encroachment along the shoreline of most larger bodies of water, and particularly rivers with fast flowing current and the Great Lakes. Smaller lakes and streams are also subject to drastic differences in water level, depending on the season and rainfall.

BRIEF SUMMARY OF THE INVENTION

The present invention, it will be seen, relates to a dock structure which is readily erected without respect to the firmness of offshore soil. The present invention further has adjustability and constructional features which serve to protect the deck and render it useful as a swimming or diving platform, a fishing platform or as a structure to moor and to service different types and sizes of boats which may be tied alongside. The basic parts of the dock are fabricated in such a manner that the entire structure may be later removed and relocated with a minimum cost of labor and with only the basic costs of resetting the concrete bases and submerged pipe which might be used in connection with the cable end holders anchored in the ground and the vertical posts.

An additional alternate feature includes the structural sizing and placement of the vertical support members to permit actual slide-out of the deck between the support members for storage on shore in the event the pivotal movement provided is insufficient to protect the deck during icing conditions. The deck alternately may be flipped over through a vertical arc between a functional position and a storage position on the shore.

The invention further includes the arrangement whereby one of the collars is releasably connected to the deck and, once freed from that collar, the deck is pivotal through a range from 90° to 270° so that it may be stored flat along the shoreline. With the proper placement and spacing, one or more additional docks may be connected and similarly aligned to provide a boardwalk structure and dock arrangement lining the shore.

BRIEF DESCRIPTION OF THE DRAWINGS

A preferred embodiment of the invention is included in the accompanying drawings in which like numerals are used to refer to like parts as they may appear in the different Figures of the drawings, and in which.

DETAILED DESCRIPTION OF THE INVENTION

Figures 1, 2, 10, 11:
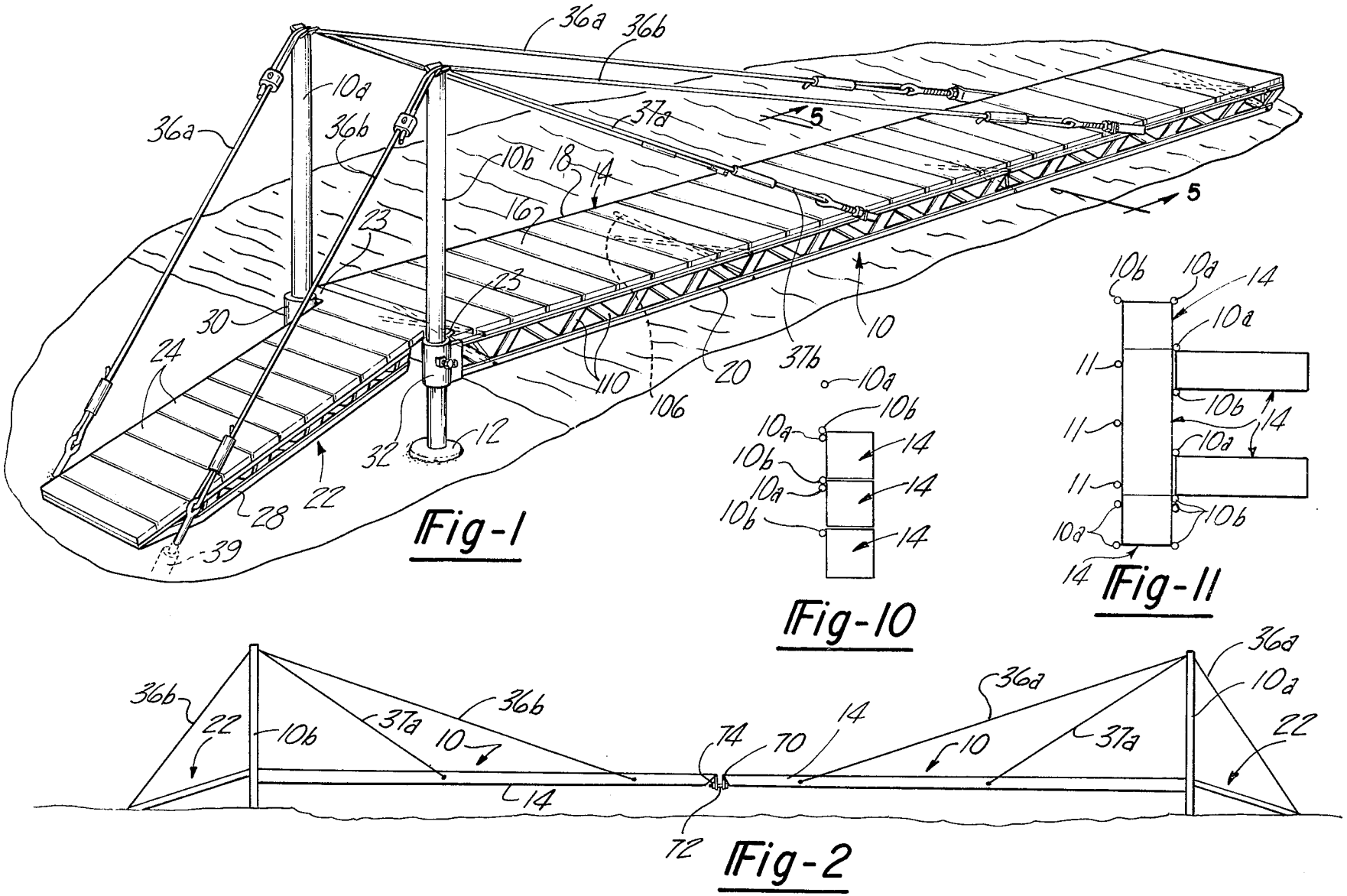
FIG. 1 is a perspective view of a dock constructed in accordance with the present invention as it is installed for use along a shoreline.
FIG. 2 is a view showing a pair of opposed end dock structures such as might be combined, connected and used to bridge a narrow body of water.
FIG. 10 is a top plan view showing a plurality of decks aligned in a boardwalk arrangement.
FIG. 11 is a top plan view showing a plurality of docks with their decks aligned in a somewhat different boardwalk arrangement.

Referring now to the accompanying drawings and with particular attention to FIG. 1, there is shown in place a suspension type dock 10. The dock 10 includes as its basic parts a pair of vertical support members or posts 10*a* and 10*b*. The vertical support members 10*a*, 10*b* are suitably anchored, for example, each in a poured concrete base 12 or in other like foundation. The deck portion of the dock is generally identified by the numeral 14. It will be seen that the superstructure of the deck 14 includes a plurality of cross planks 16 or like structural members which are supported between a pair of side girders 18 and 20, the detail of which will be further shown with more particularity in the drawings of FIGS. 3 and 5. Bars 21 are included in the construction of the girders 18 and 20 as shown.

A ramp 22 is removably connected at the left end of the deck 14 between the posts 10*a* and 10*b* to permit easy access to the deck 14 even over relatively rough terrain on the shore. The ramp 22 has right hand extended corner portions 23 which permit hooking it in place at the end of the deck 14. The ramp 22 likewise includes a number of cross planks 24 or like structural members which are mounted between a pair of similarly constructed side girders 28, one of which is shown.

Figure 8:
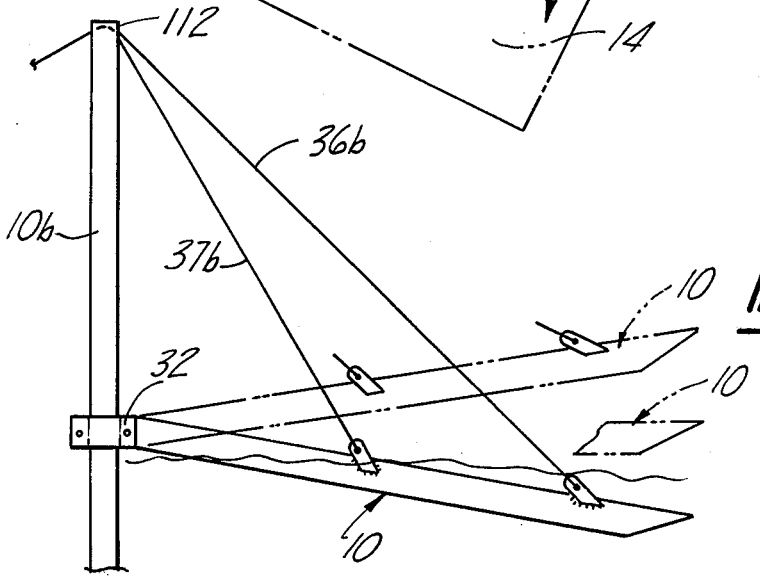
FIG. 8 is partially schematic view showing a dock with two pairs of supporting cables and in phantom line illustrating its adjustment between upper and intermediate raised positions.

Also illustrated in FIG. 1 are support cables for the dock which are connected in two opposed pairs 36*a* and 36*b*, 37*a* and 37*b*. The function of the two pair of support cables is to make pivotal and leveling adjustment of the deck 14, thus to accommodate for vertical adjustment which may be made to the deck 14 by the positioning of the collars 30 and 32. The deck 14, as will be better shown in FIG. 8, is likewise readily adjustable and tiltable upwardly or downwardly to allow for storage during the winter months or to allow for height adjustment relative to the water level and to accommodate different types of vessels. The support cables 36*a* and 36*b* are adjustable at both ends and are anchored to foundations set in the ground, such as foundation 39.

FIG. 2 shows a pair of docks 10 constructed in accordance with the present invention and having their opposed deck free ends in nose-to-nose configuration to form a continuous bridge arrangement. Each deck 14 may have a butt plate 70 connected at its end in opposing relationship one to the other and connectible through bolts or other fastening means, such as bolt 72 and nut 74, such that the bridging is completed across the body of water between the two docks 10. In other respects, the two docks are substantially the same, with the pair of vertical support members 10*a*, 10*b* and one or more pair of cables, such as cables 36*a*, 36*b* and 37*a*, 37*b*. In a like manner to the showing in FIG. 1, a ramp 22 may be connected at either end to complete the construction of the bridge.

Figure 3:
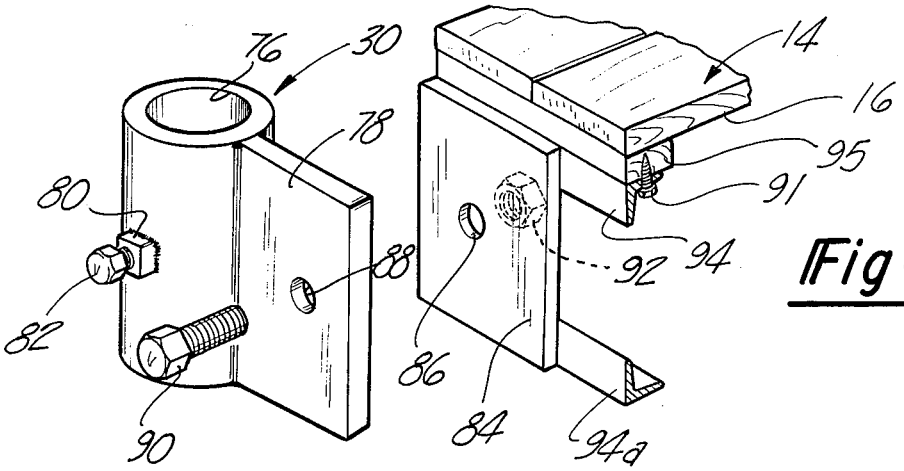
FIG. 3 is a fragmentary view showing the detail of construction of one of the vertically adjustable collars and the mode of its interconnection with the associated side of the deck portion of the dock.

FIG. 3 shows one of the vertically slidable collars 30 or 32 with an internal bore portion 76 adapted to be mounted on the related vertical support member 10*a* or 10*b*. Forwardly extending from the collar 30 is a connector extension 78, preferably formed integrally with or welded to the collar 30. To permit release or tightening of the collar 30 about the vertical support member 10*a* on which it is mounted, there is provided a nut 80 welded to the outer surface of the collar 30 and an adjusting and locking bolt 82 threadably engaged therewith and further extending through an opening in the collar 30, not shown. The deck 14 is fastened to the respective connecter extension 78 through an opposed mounting plate 84 having an opening 86 registrable with an opening 88 formed in the opposed connecter extension. The two parts are joined together in the assembly of the dock through a bolt 90 and nut 92 or similar fastener. A portion of the deck 14 structure is shown which includes the upper planks 16. Screws 91 or other suitable fastening means are used to fasten a joist 95 to an upper chord 94. A lower chord 94*a* completes the other major part of the deck assembly.

Figure 4:
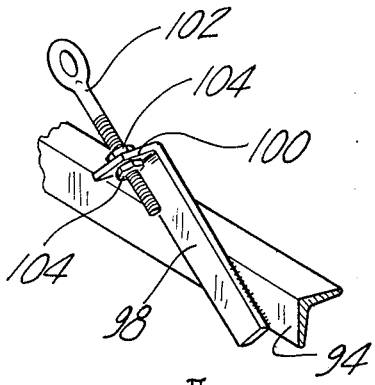
FIG. 4 is a view with parts broken away showing the manner in which the cable end is connected to the deck through an I-bolt.

FIG. 4 shows the manner in which the different cables are attached to provide for holding and selectively adjusting the height of the deck 14. For this purpose, the upper chord 94 has welded to it a bracket 98 with an outwardly formed bend 100 having an opening formed therein. An I-bolt 102 threadably engages a pair of nuts 104 so that the cable attached to the I-bolt 102 may be securely fastened in place, yet easily adjusted when the need arises.

Figure 5:
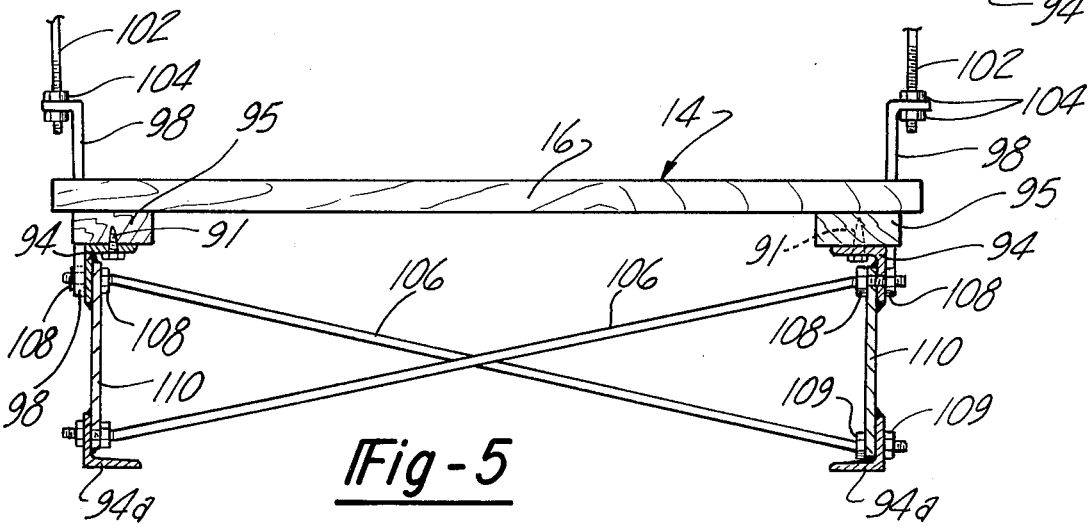
FIG. 5 is a cross-sectional view of the deck taken along the section line 5—5 of FIG. 1 to illustrate the structural detail and the bracing of the deck with bracing cross sway rods used at intervals along the deck length.

FIG. 5 shows the detail of the deck 14 and of the cross bracing structure associated with it. Included are the cross planks 16 and the I-bolts 102 with their associated locking bolts 104. The upper and lower chords 94, 94*a* are shown in the assembled position with respect to joist 95 and the remainder of the deck. FIG. 5 further clarifies the manner in which cross sway rods 106 are used to complete a well braced unitary construction for the dock. To allow for the rigid assembly of the sway bars 106, appropriate openings are provided at spaced intervals along the length of the upper and lower chords 94 and 94*a*. The sway rods 106 are suitably mounted and locked in place through locking nuts 108, 109 used to fasten their threaded end portions in place.

FIG. 5 additionally shows bars or plates 110 which are used to interconnect the upper and lower chords 94, 94*a* at spaced but substantially end-to-end intervals along the length of the deck 14. It will be further seen from FIG. 1 that the bars or plates 110 are inclined to the vertical and are so positioned through welding or other fastening means, such as nuts 108, 109, in end-to-end relationship to further contribute to the rigidity and strength of the deck assembly.

Figure 6:
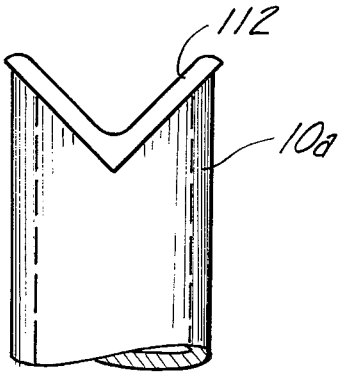
FIG. 6 is a cross-sectional view of the V-way installed at the end of the support members to allow free sliding movement of the cable.

FIG. 6 shows the upper end of one of the vertical support members 10*a* and the V-way 112 attached by welding or other like fastening to the upper end of the vertical support member 10*a*. The V-way 112 has rounded corners and allows for sliding movement of the associated cable or cables 37*a*, 36*a*, such that the deck 14 may be easily raised and lowered. A roller may be substituted for the V-way 112 if desired. It will further be seen from FIG. 6 that for convenience of construction the vertical support member 10*a* may be formed from a pipe.

Figure 7:
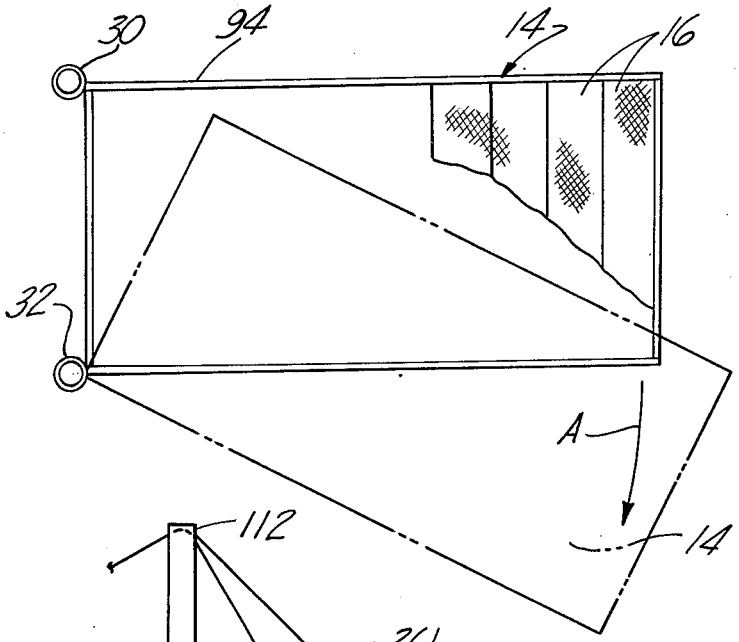
FIG. 7 is a top elevational view of one embodiment of the present invention with the deck partly broken away and having the capability of a pivotal movement about one of the two adjustment collars to allow for storage positioning of the deck away from the waterline or, alternately, to allow for its alignment with one or more other decks appropriately constructed and spaced so that a boardwalk may be made from the juxtaposing of a plurality of the docks end-to-end in their swiveled position.

FIG. 7 shows a different embodiment of the present invention wherein the dock 10 is so constructed as to allow for pivotal movement through a wide arc so that the deck 14 may be turned roughly parallel to the shoreline for storage or, alternately, positioned substantially parallel to the shoreline to allow for its use as a boardwalk or other useful recreational platform. With the proper spacing and alignment of a number of docks 10, these then may be rotated in the manner shown by the arrow A to provide a continuous boardwalk along the edges of the shoreline. This boardwalk type of arrangement is shown in FIG. 10. The several different docks 14 may be supported at their free ends by suitably positioned snub posts, not shown. The pivotal movement of each deck 14 is achieved through releasing the upper collar 30 from the opposed deck end portion and fastening means shown in detail in FIGS. 1 and 3, while the other collar 32 is left mounted on its associated vertical support member 10*b* to allow for pivotable movement of the deck 14 in the manner shown by arrow A of FIG. 7.

FIG. 8 is a drawing illustrating various moved positions of the dock 10 by means of the selective tightening or loosening of the associated cables 37*b* and 36*b*. The uppermost position shown in FIG. 8 illustrates what might be described as a storage position to provide clearance of the dock above ice or other piled debris which frequently accumulate along the shoreline during winter. The intermediate position shown illustrates one position to which the dock might be maintained during use in docking boats. The lowermost position shown in FIG. 8 represents a position to which the free end of the deck may be lowered, preferably into engagement with the ground under the water, to permit the launching of boats from automobile-drawn trailers directly into the water.

Figure 9:
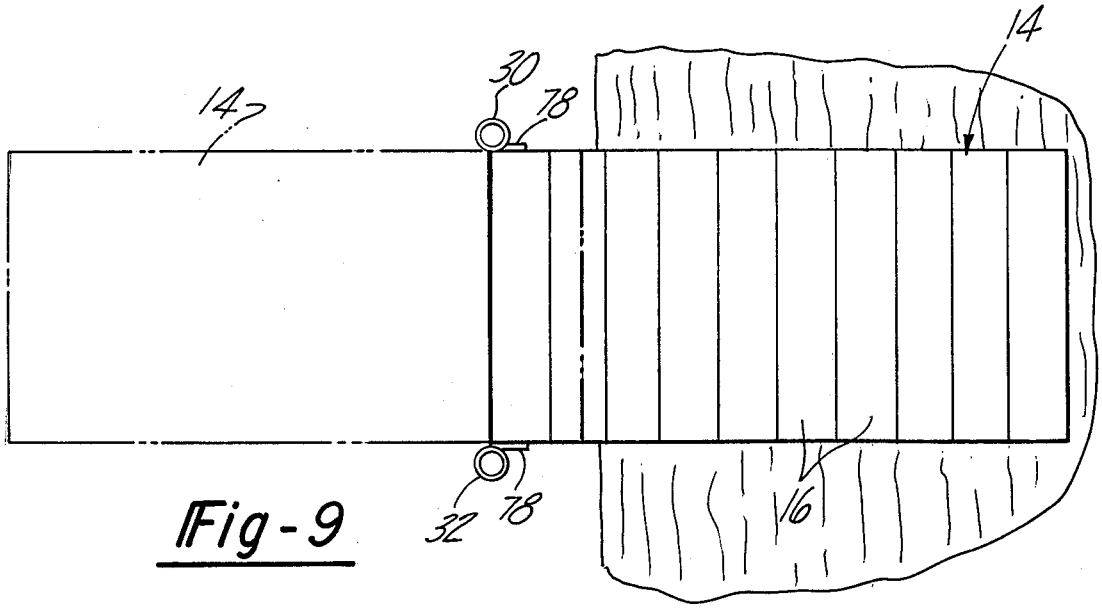
FIG. 9 is a top plan view of a still different embodiment of the present invention in which the dock is not only pivotably movable up and down but slidable between the vertical support members directly back onto the shore into a still different storage position when this is required.

FIG. 9 represents a still different embodiment of the present invention which allows for the selective adjusting of the height of the dock 10 in the manner already described, but further permits withdrawal of the deck 14 away from the water into the storage position on the shore illustrated in phantom line configuration. To allow for this storage movement, the two collars 30 and 32 are constructed with their mounting extensions 78 mounted in a manner tangential to the opposed inner edges of the collars. Thus, upon disconnection of the extension plate 78 from the opposed plates associated with the deck 14, free sliding movement may be made of the entire dock structure. In this manner, the dock has not only advantages of free vertical adjustability and storage but likewise, in the event it is desired, the entire structure can be simply detached and withdrawn or flipped back through a 180° arc to an even further removed position.

FIG. 11 shows a different boardwalk arrangement provided from a plurality of docks 10. Three docks 10 are linearly positioned to form a boardwalk lineup. Two additional docks 10 extend rightwardly across the shoreline to provide ordinary docking function over the surface of the water. A plurality of snub posts 11 are shown which are positioned to provide necessary support for the long centrally located dock 10. Each different dock has its height individually adjustable.

It will thus be seen that by the present invention I have provided a dock structure which is useful for a multiplicity of functions, including both launching, boat docking, boardwalk conversion, and a variety of readily available storage positions in addition to the one permitted by free end elevation of the deck itself. The mode of construction of the dock and the various elements from which it is fabricated provide a rigid and durable structure capable of wintering in place at the site of erection with a minimum of maintenance and attention.

What is claimed is:

1. A structure for a dock at a shoreline site comprising:

a pair of vertical support members, each having its base anchored at a point proximate the shoreline;

a slidable locking collar mounted on each of said vertical members for upward and downward adjustment;

a deck for the dock having one end connected to said collars for vertical adjustment therewith and having its other free end extending outwardly over the surface of the adjacent water;

one of said collars being releasable from said deck and the other being rotatably movable about its associated vertical member to provide for movement of the dock in a horizontal plane between a use position and a storage position substantially aligned with the shoreline;

a pair of support cables, each journaled for slidable movement across the top of a different one of said vertical members, said cables connected at their first ends respectively to the deck intermediate its ends and at their second ends to an anchoring means in the shore spaced away from the vertical members; and an adjusting means comprising a threaded means operably connected to each of the cables intermediate the anchoring means and said vertical members for providing the tightening or loosening of its associated cable to provide selected raising and lowering of the dock;

said deck adjustable by said adjusting means between, first, a lowered position in which its free end is dropped into contact with the ground beneath the surface of the water to provide a launching function, second, a position substantially level but spaced from the surface of the water for use as a dock structure and, third, a raised or storage position with the free end elevated above the surface of the water.

2. The combination as set forth in claim 1 wherein there is further provided a ramp positionable over the deck end, said ramp having extended edge portions operable to be hooked into holding relationship about each of said vertical support members.

3. The combination as set forth in claim 1 wherein there is included a second pair of support cables likewise connected between the upper ends of said vertical support members and a further anchoring point intermediate the point of connection of said first mentioned cables with said deck and said vertical support members.

4. The combination as set forth in claim 1 wherein each of said vertical support members includes at its upper end portion a V-way with rounded edge portions for allowing free sliding movement of said cables during the height adjustment of said deck.

5. The combination as set forth in claim 1 wherein said deck comprises a pair of girders mounted at opposite sides of the deck and wherein a plurality of cross-oriented bracing sway rods are mounted in a rigid manner between said girders.

6. The combination as set forth in claim 1 wherein a plurality of such docks are mounted in spaced relationship one to the other to provide a substantially continuous boardwalk arrangement along the shoreline in said storage position substantially aligned with the shoreline.

7. The combination as set forth in claim 1 wherein a first plurality of said dock structures are aligned to provide a boardwalk arrangement in a line substantially parallel to said shoreline and wherein a second plurality of said dock structures spaced one from the other are mounted having their respective vertical support member associated ends proximate one side of said arrangement and having their respective free ends extending outwardly over the water to provide a docking function.

8. The combination as set forth in claim 1 wherein each of said collars has connected to it a connector extension, each of said opposed deck ends has fixed to it a mounting plate, and wherein a threaded fastening means is operably connected between each such extension and plate for holding each such deck end to its respective collar, whereby ready release and reattachment of the dock is made to provide said rotatable movement between said use and storage positions.

* * * * *